US008201602B2

(12) United States Patent
Maeng et al.

(10) Patent No.: US 8,201,602 B2
(45) Date of Patent: Jun. 19, 2012

(54) HEAD COVER FOR GOLF CLUBS

(76) Inventors: Seop Maeng, Gyeonggi-do (KR); Seoe-Young Maeng, Seoul (KR)

( * ) Notice: Subject to any disclaimer, the term of this patent is extended or adjusted under 35 U.S.C. 154(b) by 347 days.

(21) Appl. No.: 12/271,221

(22) Filed: Nov. 14, 2008

(65) Prior Publication Data

US 2009/0133790 A1 May 28, 2009

(30) Foreign Application Priority Data

Nov. 27, 2007 (KR) ..... 10-2007-0121209
Feb. 1, 2008 (KR) ..... 10-2008-0010559

(51) Int. Cl.
*A63B 57/00* (2006.01)

(52) U.S. Cl. ..... 150/160
(58) Field of Classification Search ..... 150/160, 150/159
See application file for complete search history.

(56) References Cited

U.S. PATENT DOCUMENTS

| | | | | | |
|---|---|---|---|---|---|
| 1,697,916 | A * | 1/1929 | Kaufmann | ..... | 190/106 |
| 1,894,884 | A * | 1/1933 | Page | ..... | 55/369 |
| 2,466,208 | A * | 4/1949 | Chanslor et al. | ..... | 2/48 |
| 5,133,553 | A * | 7/1992 | Divnick | ..... | 473/245 |
| 5,358,110 | A * | 10/1994 | Simpson | ..... | 206/316.2 |
| 5,495,967 | A * | 3/1996 | Parton | ..... | 224/610 |
| 6,119,742 | A * | 9/2000 | Maeng | ..... | 150/160 |
| 6,793,072 | B2 * | 9/2004 | Maeng | ..... | 206/315.2 |
| 6,908,550 | B2 * | 6/2005 | Silverstein | ..... | 210/167.17 |

* cited by examiner

*Primary Examiner* — Tri Mai
(74) *Attorney, Agent, or Firm* — Kratz, Quintos & Hanson, LLP

(57) ABSTRACT

Disclosed herein is a head cover for golf clubs. The head cover includes an open-and-shut frame, a head cover body, and a locking unit. The open-and-shut frame includes wings which are opened by elastic force of elastic means. The head cover body accommodates the open-and-shut frame therein, and includes an entrance and a receiving space for receiving the golf club. The locking unit is secured to the outer surface of the middle portion of the head cover body, thus closing the entrance of the head cover body opened by the open-and-shut frame.

10 Claims, 11 Drawing Sheets

HEAD COVER FOR GOLF CLUBS

BACKGROUND OF THE INVENTION

1. Field of the Invention

The present invention relates generally to a head cover for golf clubs and, more particularly, to a head cover for golf clubs, in which an open-and-shut frame is installed in the head cover to open or close the head cover and the operation of opening or closing the head cover having the open-and-shut frame therein can be done with only one hand, thus allowing a user to hold a golf club with one hand and the head cover with the other hand and thereby affording the convenient use of the head cover for golf clubs, and thus simplifying the structure of the open-and-shut frame and thereby reducing manufacturing costs.

2. Description of the Related Art

Generally, various types of protective covers for golf clubs have been proposed. Most of the protective covers are manufactured using cloth to cover the head of a golf club C. As shown in FIG. 1, a protective cover is formed in the shape of a pouch to surround both a head H and the upper portion of a shaft S of the golf club C, and is cut in the longitudinal direction of the cover so that the head H and the shaft S of the golf club C are easily inserted into the protective cover. Further, a slide fastener Z is attached to the cut portion of the cover. Thus, after the slide fastener Z attached to the protective cover A is opened, the golf club C is inserted into the protective cover A. Subsequently, when the slide fastener Z is closed, the protective cover A can protect the head H and the upper portion of the shaft S of the golf club C. However, such a protective cover A is problematic in that the slide fastener Z must be opened or closed with both hands, so that it is complicated and inconvenient to use the protective cover A.

In order to solve the problem, as shown in FIG. 2, U.S. Pat. No. 6,202,723 has been proposed by the inventor of the present invention, which is constructed so that a protective cover is bent to be opened or closed. However, the protective cover is problematic in that only the elastic force of the cover itself is used, so that elastic restoring force is weak and the operation of opening or closing the protective cover is not smooth. Further, in the case where the protective cover is covered with protective cloth, the thickness of the protective cover is increased. This hinders the smooth operation of the protective cover. Moreover, in order to open or close the protective cover, the protective cover must be bent. However, the bending operation is not smooth, so that it is very difficult to open or close the protective cover with only one hand. When the protective cover is opened for the insertion of a golf club, a hinge part provided along the central line of the protective cover protrudes like a hump, so that it is inconvenient to put the golf club into the protective cover. Because of the protrusion, the golf club may slip to one side during the insertion of the golf club, so that it is inconvenient to use.

Further, as shown in FIG. 3, the protective cover according to U.S. Pat. No. 6,119,742 includes a hinge part, and a pair of cover parts which are coupled to each other via a hinge pin. As in the former patent, when the protective cover is opened for the insertion of a golf club, the hinge part provided along the central line of the protective cover protrudes like a hump, so that it is inconvenient to put the golf club into the protective cover. Because of the protrusion, the golf club may slip to one side during the insertion of the golf club, so that it is inconvenient to use. A portion for receiving the head of the golf club includes a top wall F1, a side wall F2, and a bottom wall F3, and the protective cover is manufactured through injection molding. Meanwhile, golf clubs manufactured by several manufacturing companies have different sizes and the difference in size is considerable. Further, the molded products are not compatible with one another, so that it is inconvenient to use and several models of protective covers are required.

Further, several head covers invented by the same inventor as the present invention have respective characteristics, but have several problems when the head covers are actually used. For example, in the case of using an elastic cord, the durability of the elastic cord is too small and the elastic cord is in contact with the head cover throughout the entire length of the elastic cord, so that the elastic cord may adhere to the head cover. In this case, operating force is not constant, thus causing the imbalance of force and thereby leading to non-uniform operation. Further, the manufacturing costs of the head cover are high, so that the marketability of the head cover is low.

SUMMARY OF THE INVENTION

Accordingly, the present invention has been made keeping in mind the above problems occurring in the prior art, and an object of the present invention is to provide a head cover for golf clubs, which has a simple structure, thus being easy to manufacture and enabling smooth opening and closing operation, therefore reducing manufacturing costs, and which can be utilized regardless of the size of a golf club, thus being convenient to use.

In order to accomplish the above object, the present invention provides a head cover for golf clubs which detachably covers the head of a golf club to protect the head, and includes a head cover body and an open-and-shut frame. The head cover body is made of cloth, and includes a head cover part which covers the head of the golf club to protect the head and a shaft cover part which extends downwards from the head cover part to surround a shaft. The open-and-shut frame is inserted into and secured to the head cover body, and includes a hinge groove which extends in a longitudinal direction, wings which are rotated around the hinge groove to be opened or closed, and elastic means which are secured to the upper and lower portions and left and right portions of the hinge groove and elastically bias the wings in an opening direction.

BRIEF DESCRIPTION OF THE DRAWINGS

The above and other objects, features and advantages of the present invention will be more clearly understood from the following detailed description taken in conjunction with the accompanying drawings, in which.

DESCRIPTION OF THE PREFERRED EMBODIMENTS

Figure 1:
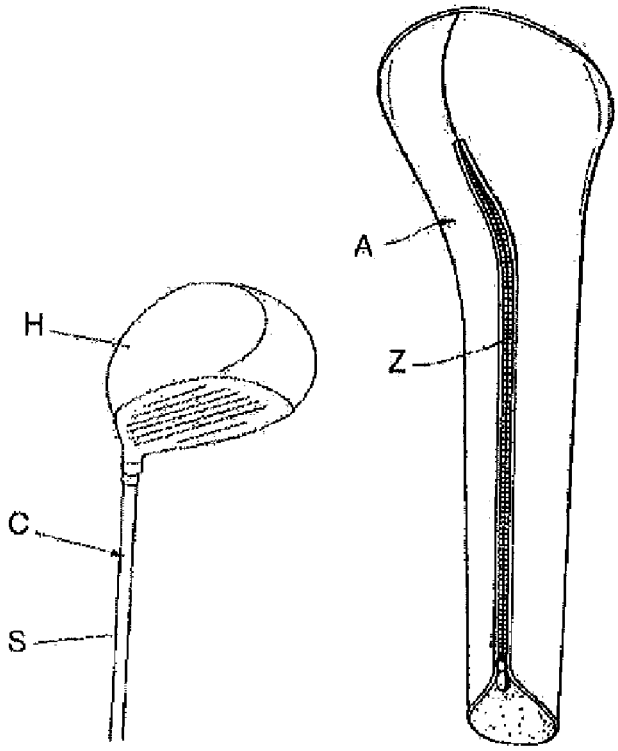
FIG. 1 is a perspective view illustrating a conventional protective cover for golf clubs.
Figure 2:
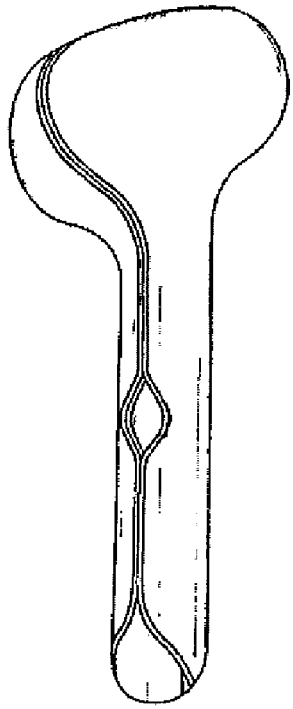
FIG. 2 is a perspective view illustrating another conventional protective cover for golf clubs.
Figure 3:
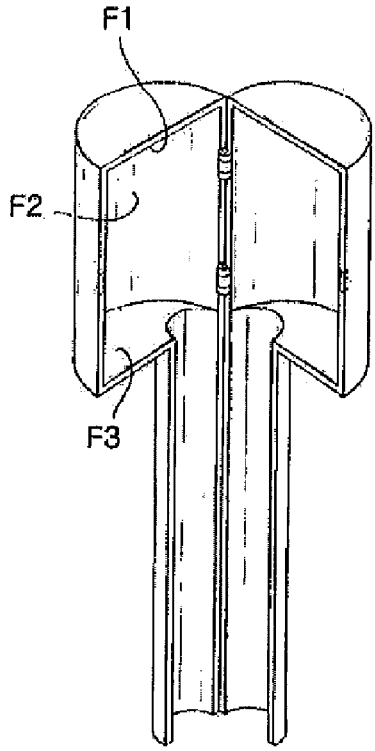
FIG. 3 is a perspective view illustrating a further conventional protective cover for golf clubs.

Reference now should be made to the drawings, in which the same reference numerals are used throughout the different drawings to designate the same or similar components.

As shown in FIGS. 4 to 7, a head cover A for golf clubs according to the first embodiment of the present invention includes an open-and-shut frame 1, a head cover body 2, and a locking unit 3. The open-and-shut frame 1 includes wings 11 which are unfolded and folded. The head cover body 2 accommodates the open-and-shut frame 1 therein and includes an entrance and a receiving space for receiving a golf club G. The locking unit 3 is secured to the outer surface of the middle portion of the head cover body 2 and functions to open or close the entrance of the head cover body 2.

Figure 6:
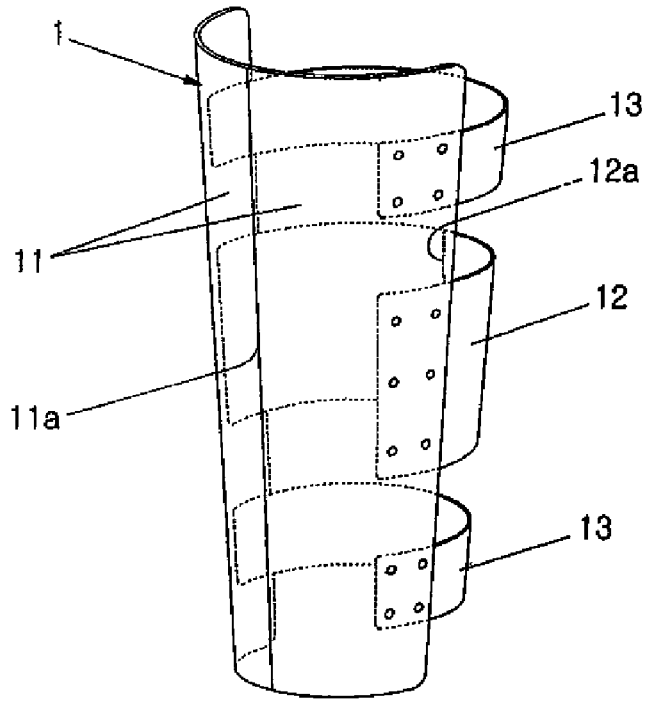
FIG. 6 is a perspective view illustrating an open-and-shut frame which is to be installed in the head cover for golf clubs according to the first embodiment of the present invention.
Figure 7:
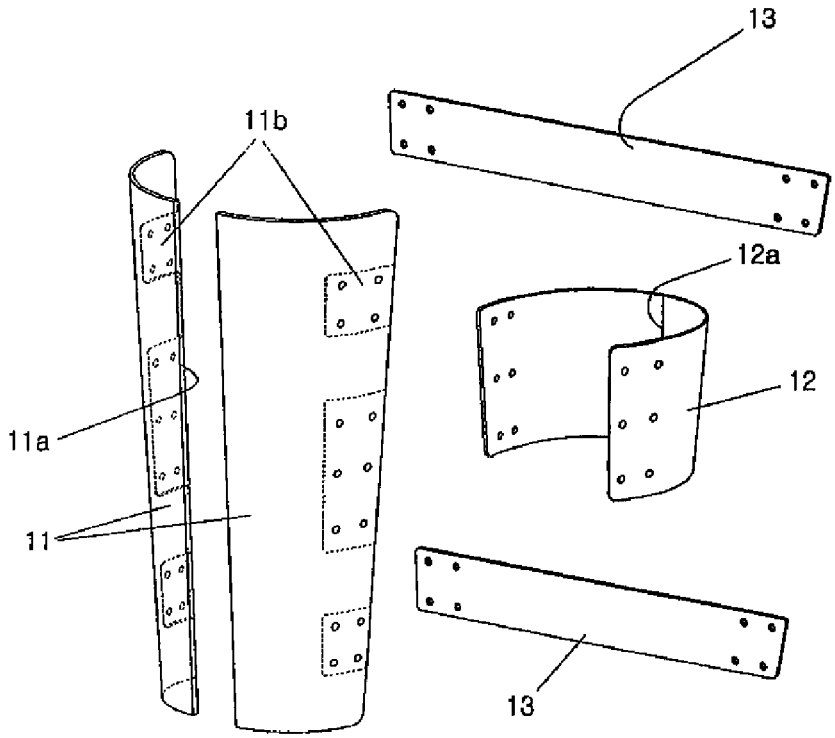
FIG. 7 is an exploded perspective view illustrating the open-and-shut frame of FIG. 6.

According to this embodiment, as shown in FIGS. 6 and 7, the open-and-shut frame 1 includes a pair of arc-shaped wings 11 which extend in a vertical direction, a semi-circular wing support part 12, and a pair of elastic means 13. The wing support part 12 is provided on the lower portion of the wings 11 and fastened to the wings 11, with a hinge groove 12*a* formed vertically along the central portion of the wing support part 12. The elastic means 13 are provided on the opposite sides of the wing support part 12, are coupled at both ends thereof to the lower portions of the wings 11, and elastically bias the open-and-shut frame 1 in an opening direction.

In this embodiment, the wings 11 are manufactured using hard synthetic resin, and fastening holes 11*b* are formed in the lower portions of the wings 11 such that the wing support part 12 and the elastic means 13 are fastened to the wings 11 through the fastening holes 11*b*. According to this embodiment, the wing support part 12 and the elastic means 13 are coupled to the wings 11 through riveting.

Figure 10:
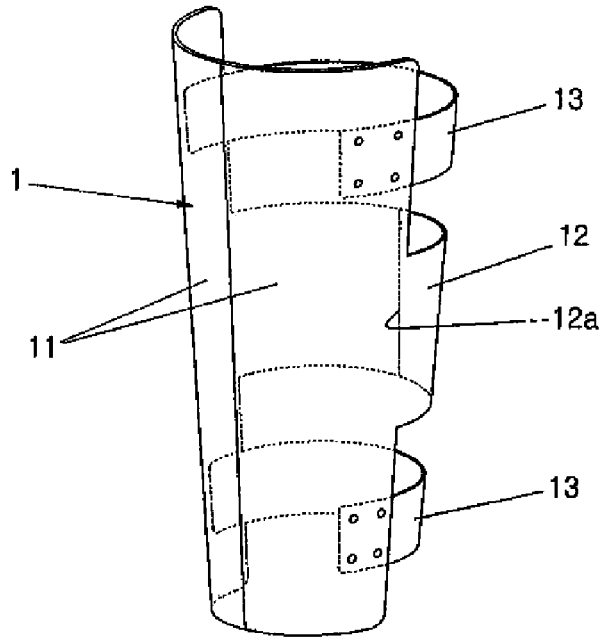
FIG. 10 is a perspective view illustrating an open-and-shut frame according to the second embodiment of the present invention.

FIG. 10 illustrates an open-and-shut frame 1 according to the second embodiment. The open-and-shut frame 1 is constructed so that wings 11 and a wing support part 12 are integrated into a single structure using synthetic resin. A hinge groove 12*a* is formed in the wing support part 12 in such a way as to extend vertically, and elastic means 13 are fastened to the lower portions of the wings 11. Such a construction further can simplify the structure of the open-and-shut frame 1. According to this embodiment, the open-and-shut frame 1 is made of synthetic resin, but material other than the synthetic resin may be used.

According to this embodiment, the elastic means 13 comprises a plate spring. However, without being limited to the plate spring, the elastic means may be made of an elastic wire, plate-shaped fiber glass or rod-shaped fiber glass having elasticity.

Figure 8A:
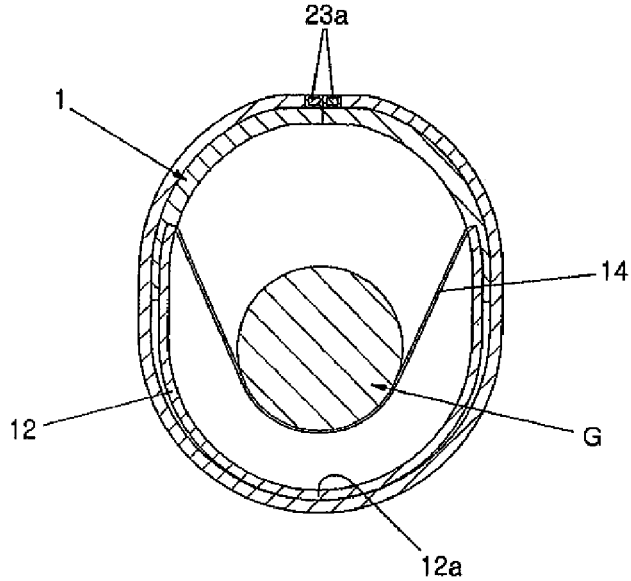
FIGS. 8*a* and 8*b* are schematic sectional views illustrating the operation of the head cover for golf clubs according to the first embodiment of the present invention.
Figure 8B:
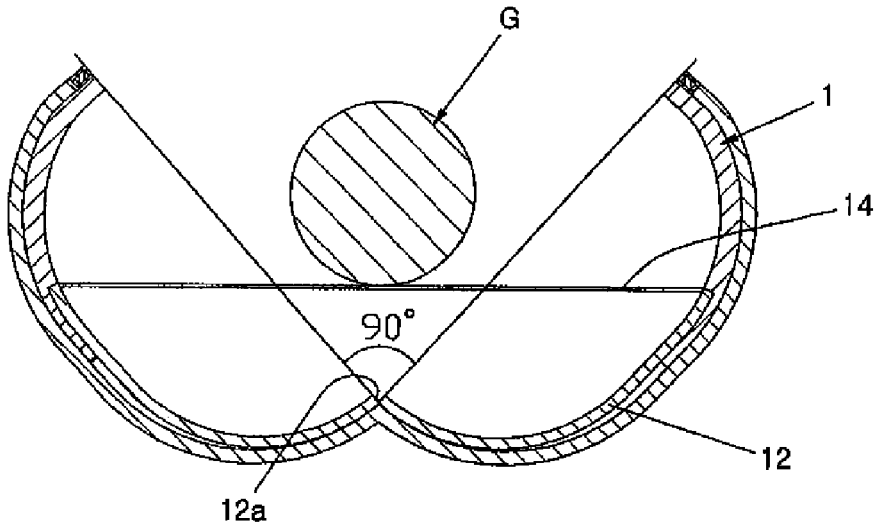
Figure 9:
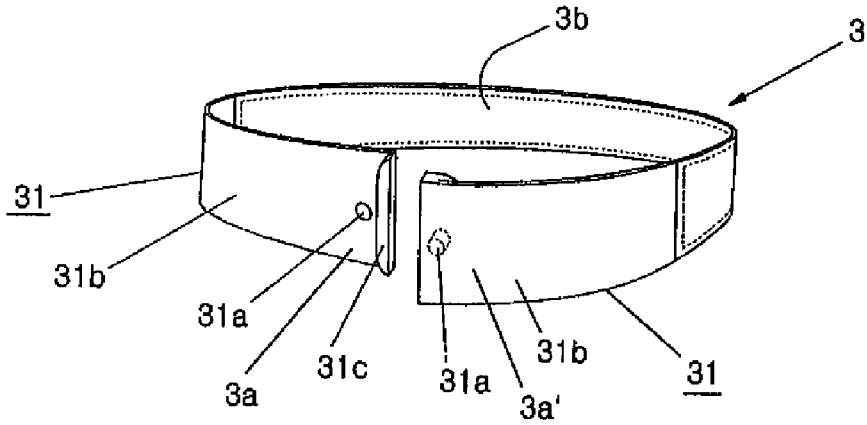
FIG. 9 is a perspective view illustrating a locking unit of the head cover for golf clubs according to the first embodiment of the present invention.

An angle limiting part 14 is mounted to the wings 11 of the open-and-shut frame 1 which face each other, and functions to limit the opening angle of the open-and-shut frame 1 (see FIGS. 8*a* and 8*b*). The preferable opening angle of the open-and-shut frame 1 which is formed between ends of the wings 11 and the hinge groove 12*a* is about 90°. If the opening angle ranges from about 70° to 120°, the open-and-shut frame 1 can be operated using one hand without difficulty. However, when the opening angle is 70° or less, it is inconvenient to put a golf club G into the head cover. Meanwhile, when the opening angle exceeds 120°, it may be inconvenient or impossible to close the head cover using one hand. Thus, the opening angle may be determined by the width of the angle limiting part 14. According to this embodiment, the angle limiting part 14 is secured to the ends of the wings 11. However, the angle limiting part 14 may not be secured to the ends of the wings 11 but may be mounted to the entrance 23 of the head cover body 2.

Each of connecting parts 11*a* of the facing wings 11 of the open-and-shut frame 1 is formed to be flat. Thus, when the head cover body 2 is closed, the connecting parts 11*a* come into contact each other without being misaligned.

The head cover body 2 includes a head cover part 21 which covers the head G1 of the golf club G to protect the head G1, and a shaft cover part 22 which extends downwards from the head cover part 21 to surround the shaft G2 of the golf club G. The head cover body 2 is made of cloth. However, the head cover body 2 may be manufactured using synthetic resin.

Figure 4:
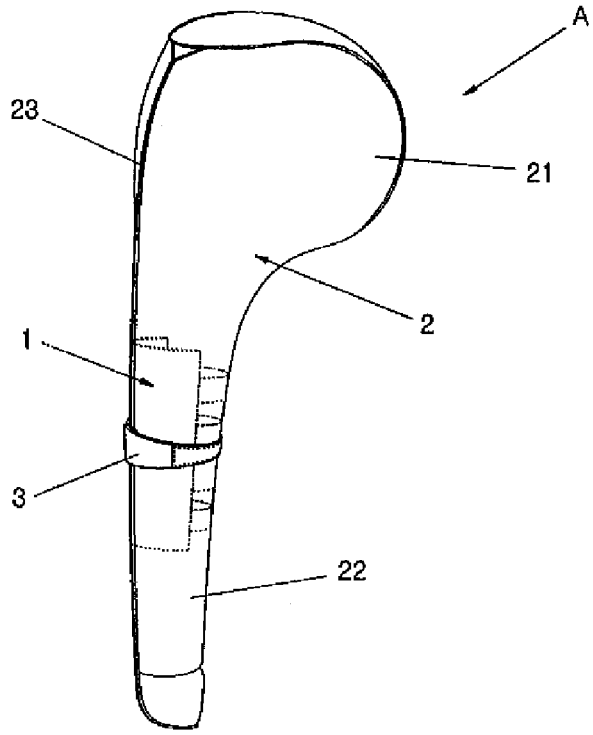
FIG. 4 is a perspective view illustrating a head cover for golf clubs according to the first embodiment of the present invention.
Figure 5:
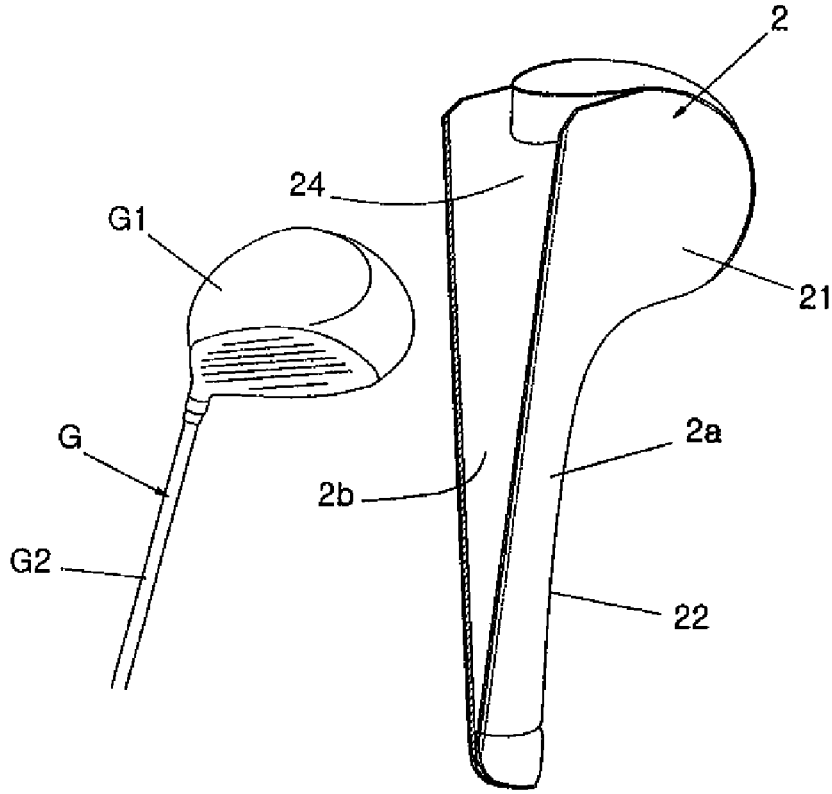
FIG. 5 is a perspective view illustrating the state in which the entrance of the head cover of FIG. 4 is opened.

As shown in FIGS. 4 and 5, the head cover body 2 includes the entrance 23 and the receiving space 24 to receive the golf club G. The head cover body 2 includes an outer covering 2*a* which is exposed to the outside, and an inner liner 2*b* which is in contact with the golf club G and defines the receiving space 24.

Figure 11:
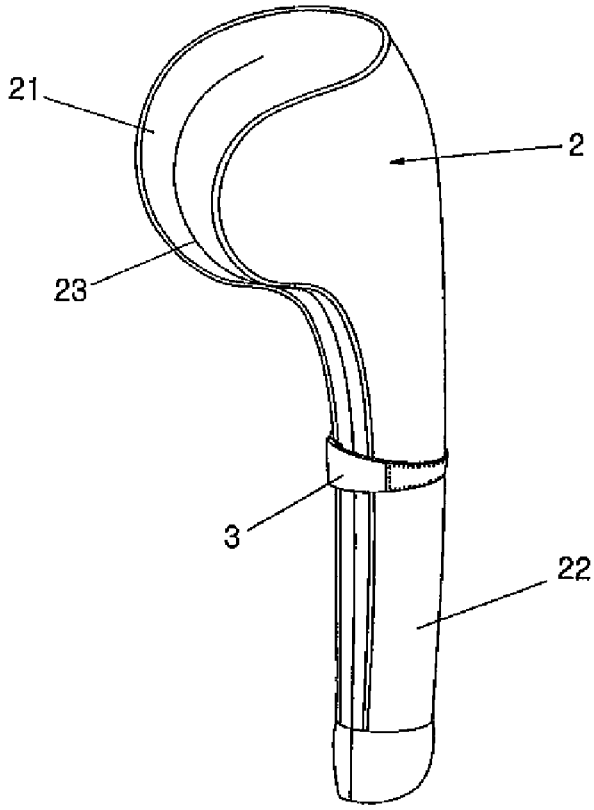
FIG. 11 is a perspective view illustrating a head cover for golf clubs according to the third embodiment of the present invention.
Figure 12:
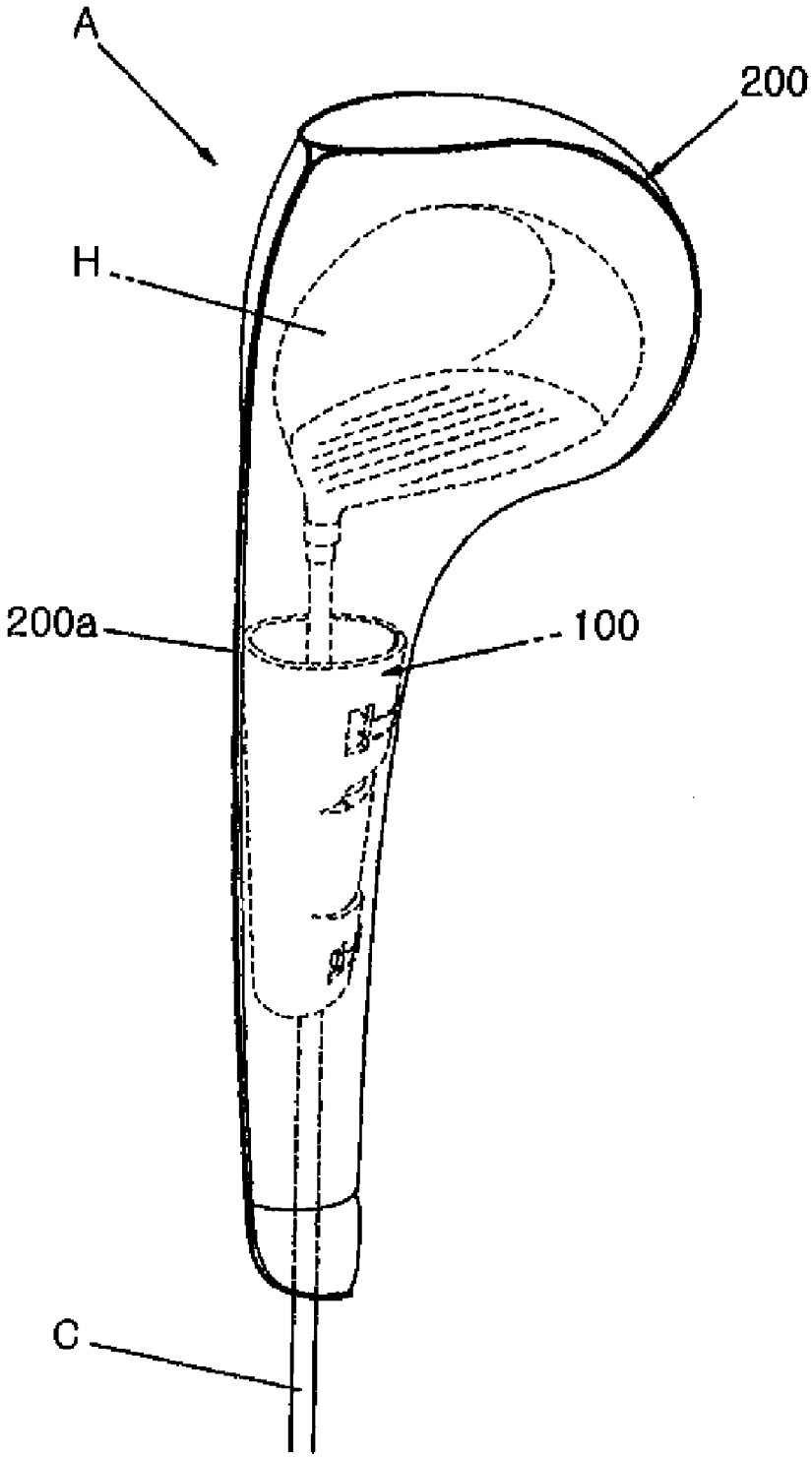
FIG. 12 is a perspective view illustrating a head cover for golf clubs according to the fourth embodiment of the present invention.

Reinforcing parts 23*a* which have a rectangular cross-section and are made of synthetic resin are installed at the entrance 23 of the head cover body 2 in such a way as to face each other. Thereby, when the head cover A is opened or closed, the reinforcing parts 23 allow the entire portion of the entrance 23 from the upper end thereof to the lower end thereof to be integrally operated, and allow the head cover body 2 to be firmly closed without being misaligned. According to this embodiment, the entrance 23 is formed on a predetermined portion of the head cover body 2 in a straight line from the head cover part 21 to the shaft cover part 22. However, as shown in FIG. 11, according to the third embodiment, the entrance 23 may be formed on a predetermined portion of the head cover body 2 in a curved line from the convex head cover part 21 to the shaft cover part 22.

The locking unit 3 is secured to the middle portion of the outer covering 2*a* of the head cover body 2 to surround the entrance 23 of the head cover body 2. A magnet 31*a* is mounted to the free end 3*a* of a locking part 31 which is provided on one end of the locking unit 3, and a support part 3*b* is secured to the outer covering 2*a*. Further, a magnet 31*a* is mounted to the free end 3*a*' of a locking part 31 which is provided on the other end of the locking unit 3, and the support part 3*b* is secured to the outer covering 2*a*. The free ends 3*a* and 3*a*' to which the magnets 31*a* of the locking parts 31 are mounted are made of synthetic resin, and the support part 3*b* is made of cloth. A hook 31*c* is provided on a surface of a support body 31*b* which supports the magnet 31*a* provided on the free end 3*a* of one locking part 31, and a support body 31*b* which supports the magnet 31*a* provided on the free end 3*a*' of the other locking part 31 is hooked to the hook 31*c* to be secured thereto. The locking of the locking unit 3 is automatically performed using magnetic force between the magnets 31*a*, while the release of the locking unit 3 is performed by detaching the magnets 31*a* from each other or pushing the magnets 31*a*.

The operation of the head cover A for golf clubs according to the first embodiment of the present invention which is constructed as described above will be described below.

When the golf club G is put into the head cover A, the entrance 23 of the head cover A is opened by the elastic force of the elastic means 13. In the state where the head cover A is opened at about 90° by the angle limiting part 14, the golf club G is pushed into the receiving space 24 of the head cover body 2. Subsequently, the head cover A is closed with the hand which holds the head cover A. At this time, while the elastic restoring force of the elastic means 13 is overcome, the open-and-shut frame 1 provided in the head cover A rotates around the hinge groove 12*a* of the wing support part 12, and the entrance 23 of the head cover A is closed. Further, the support bodies 31*b* supporting the free ends 3*a* and 3*a*' provided on both sides of the locking unit which move together come into contact with each other, and the magnets 31*a* supported by the support bodies 31*b* are attracted to each other, so that the locking of the head cover A is completed.

When a user desires to take the golf club G out from the head cover A which is locked, he or she holds the head cover A with one hand and the golf club G with the other hand. In this state, the attached locking parts 31 of the locking unit 3 are pushed away from each other with the fingers of the hand holding the head cover A. At this time, the locking parts 31 of the locking unit 3 are easily detached from each other. As such, when the locking parts 31 are detached from each other, the wings 11 of the open-and-shut frame 1 are opened by the elastic restoring force of the elastic means 13, so that the entrance 23 of the head cover A is opened. When the entrance 23 is opened as such, the golf club G may be put into the head cover A in the above-mentioned method. Thus, the golf club can be easily put into and taken out from the head cover A with one hand.

As shown in FIGS. 12 to 15, the head cover A for golf clubs according to the fourth embodiment of the present invention includes an open-and-shut frame 100 and a head cover body 200. The open-and-shut frame 100 includes wings 110 which are opened or closed. The head cover body 200 accommodates the open-and-shut frame 100 therein, and includes an entrance 200*a* and a receiving space 200*b* for receiving the golf club C.

Figure 13A:
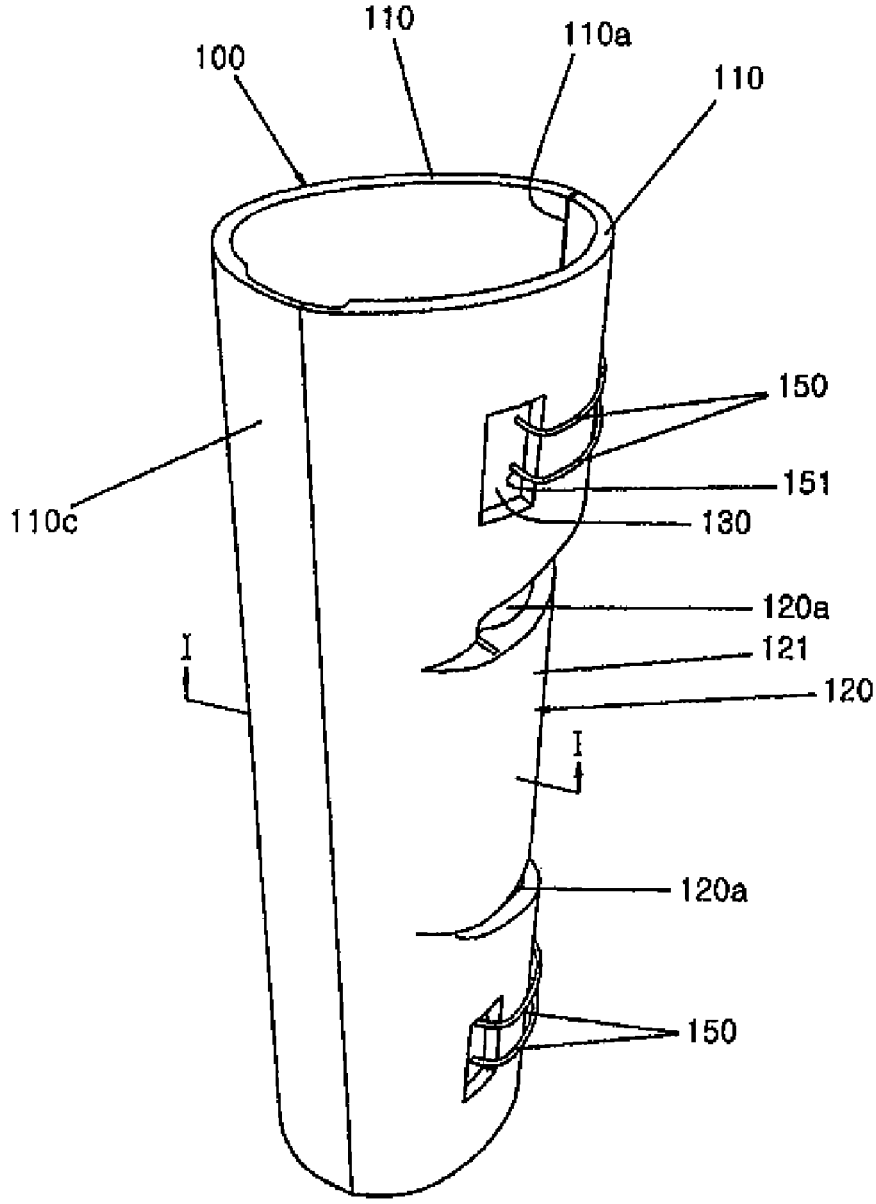
FIGS. 13*a* and 13*b* are perspective views illustrating the state in which an open-and-shut frame used in the head cover of FIG. 12 is closed and opened, respectively.
Figure 13B:
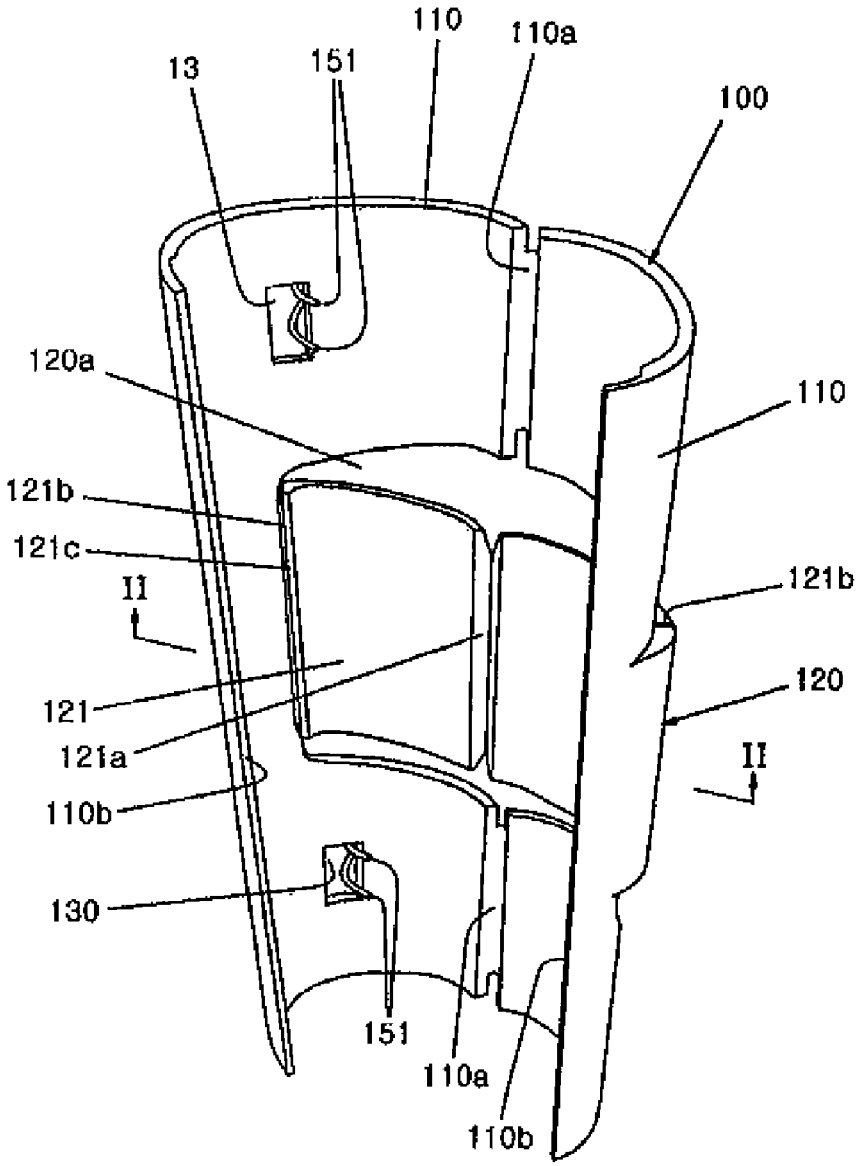

According to this embodiment, as shown in FIGS. 13*a* and 13*b*, the open-and-shut frame 100 includes a pair of wings 110, an actuating part 120, and elastic means 150. The wings 110 each having an arc-shaped cross-section extend vertically and are separated from each other along a V-shaped notched groove 110*a*. The actuating part 120 is provided on the central portion of the wings 110 in such a way as to be positioned at the middle portion of the V-shaped notched groove 110*a*, and actuates the wings 110 to open or close the wings 110. One end of each elastic means 150 is locked to a locking hole 130 which is formed in one wing 110, while the other end is locked to a locking hole 130 which is formed in the other wing 110, so that the elastic means 150 is curved to be similar to a circular shape.

Figure 14:
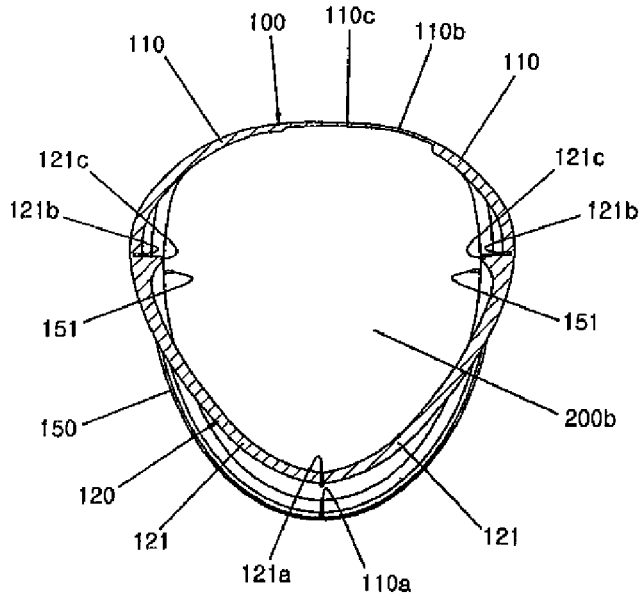
FIG. 14 is a sectional view taken along line I-I of FIG. 13*a* and illustrating the open-and-shut frame.

As shown in FIGS. 13*a* and 13*b*, separation surfaces 110*b* of the wings 110 which are separated from or are in contact with each other are inclined from an upper portion to a lower portion, thus allowing the large area of the palm to be placed on the open-and-shut frame 100. Such a construction enables the easy opening and closing operation of the open-and-shut frame 100. Further, as shown in FIG. 14, a flat grasp surface 110*c* is formed on the upper portion of one wing 110 to allow a user to easily grasp the open-and-shut frame 100.

Figure 16:
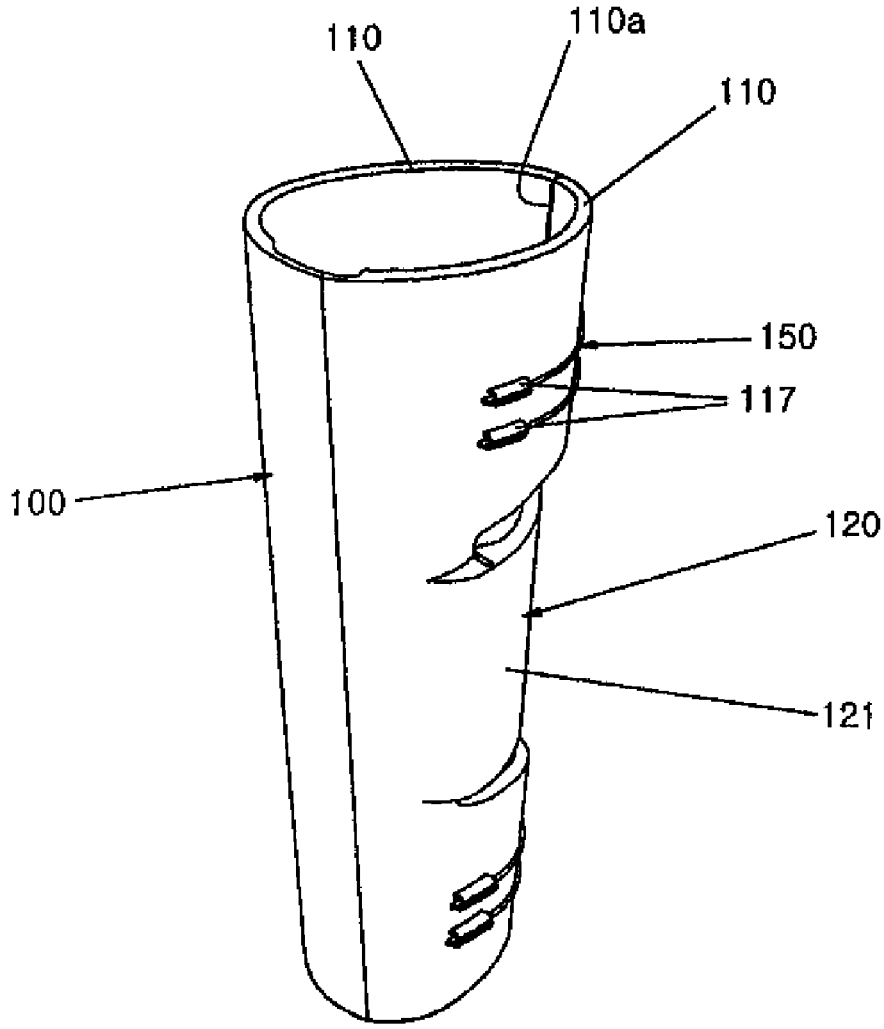
FIG. 16 is a perspective view illustrating an open-and-shut frame used in a head cover for golf clubs according to the fifth embodiment of the present invention.

Each of the locking holes 130 which are formed in the upper and lower portions of the wings 110 has a rectangular shape, and supports one end of each elastic means 150. Each locking hole 130 may have a circular shape. According to this embodiment, a bent end 151 of each elastic means 150 is locked to an associated locking hole 130. However, without being limited to such a construction, as shown in FIG. 16, the elastic means 150 may be locked in a snap locking method. That is, when the elastic means 150 are inserted into a plurality of locking protrusions 117 formed on the outer portions of the wings 110, each locking protrusion 117 is opened. After each end of the elastic means 150 has been inserted into the corresponding locking protrusion 117, the locking protrusion 117 returns to its original state.

The actuating part 120 includes two curved actuating plates 121. The actuating plates 121 are coupled to each other so that the actuating part 120 has a semi-circular cross-section. Separation parts 120*a* are provided on the upper and lower surfaces of the actuating part 120 to be separated from the wings 110. Both side surfaces of the actuating plates 121 constituting the actuating part 120 have V-shaped end notched grooves 121*b* so that the actuating plates 121 are coupled to the wings 110. A V-shaped central notched groove 121*a* is formed in the junction of the actuating plates 121. Thus, the wings 110 and the actuating part 120 are integrally coupled to each other via the central notched groove 121*a* and the end notched grooves 121*b*.

Figure 15:
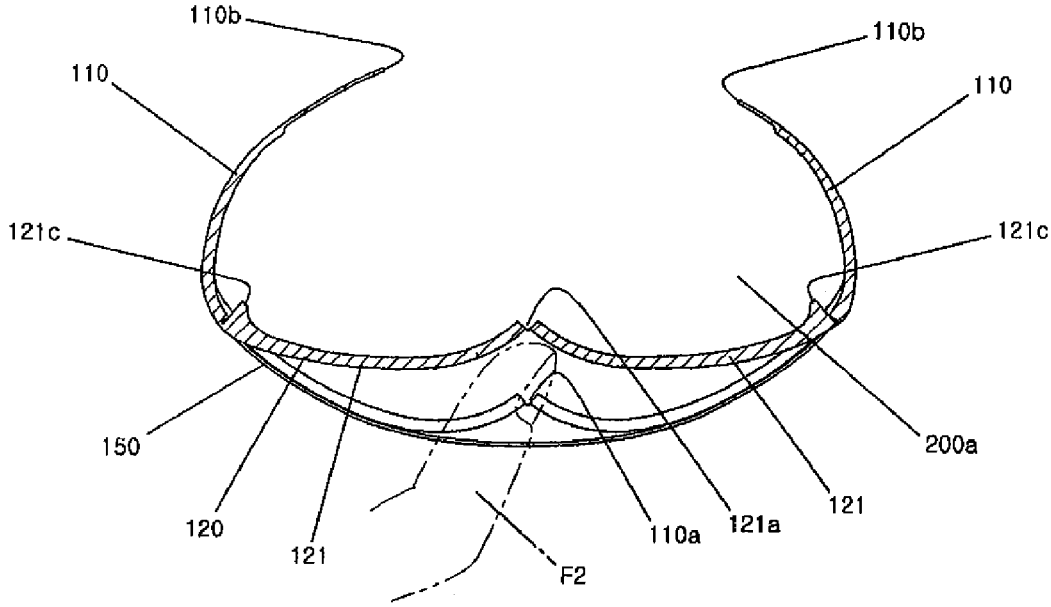
FIG. 15 is a sectional view taken along line II-II of FIG. 13*b* and illustrating the open-and-shut frame.

The actuating part 120 performs opening and closing operation using the central notched groove 121*a* and the end notched grooves 121*b*. When upward force acts on the central notched groove 121*a*, as shown in FIG. 15, the central notched groove 121*a* of the actuating part 120 is raised, so that the distance between the end notched grooves 121*b* of the actuating plates 121 is increased and the wings 110 are pushed. Thereby, the wings 110 are opened. According to this embodiment, as shown in FIG. 14, when the wings 110 are closed, the central notched groove 121*a* of the actuating part 120 is located above the notch 110*a* of the wings 110, so that the wings 110 can be easily opened or closed. Further, as shown in FIGS. 14 and 15, an upward movement prevention step 121*c* is provided on an end of the end notched groove 121*b* of each actuating plate 121 to prevent the actuating plate 121 from excessively rising.

According to this embodiment, the elastic means 150 are installed at two places, that is, the upper and lower portions of the open-and-shut frame 100. Each elastic means 150 is manufactured by curving a hard steel wire in a circular shape and bending each end of the hard steel wire to form the bent end 151. Each elastic means 150 comprises spring steel and is curved to be similar to a circular shape. Thus, the elastic means 150 bias the wings 110 in a closing direction, thus keeping the wings 110 closed. Since the head cover A of the present invention having the open-and-shut frame 100 therein is always closed, an additional locking device is not required.

Each elastic means 150 is provided on the outer surface of the open-and-shut frame 100, and is made of several hard steel wires of a small diameter rather than a hard steel wire of a large diameter so that the elastic means 150 is smoothly elastically operated when the head cover A is opened or closed. However, if necessary, each elastic means may be made of the hard steel wire having a large diameter.

The actuating part 120 is constructed so that the two actuating plates 121 are coupled to each other via the central notched groove 121*a* to rotate around the central notched groove 121*a*. Both side surfaces of the actuating plates 121 are rotatably coupled to the wings 110 via the end notched grooves 121*b*.

The operation of the protective cover A for golf clubs according to the fourth embodiment of the present invention will be described below. When a user desires to receive the head H of the golf club in the head cover A, in the state of FIG. 14, the head cover A is held with his or her hand and force is applied upwards by the fingers F2, so that the central notched groove 121*a* provided on the center of the actuating part 120 is raised upwards. When the upwardly acting force becomes larger than the elastic force of each elastic means 150, the elastic force of the elastic means 150 is reduced, and the central notched groove 121*a* is raised upwards. Further, force acts on the pair of actuating plates 121 which are integrally coupled to each other via the central notched groove 121*a*, so that the actuating plates 121 are opened.

As soon as the actuating plates 121 are opened, the wings 110 which are coupled integrally to the actuating plates 121 via the V-shaped end notched grooves 121*b* are simultaneously opened. Thereby, the head cover body 200 of the head cover A is opened, so that the entrance 200*a* for receiving the golf club C is opened. As such, when the entrance 200*a* is opened, the receiving space 200*b* is enlarged to receive the golf club C (see FIG. 15).

When the golf club C is inserted into the receiving space 200*b* and the open-and-shut frame 100 is released from the fingers, with the entrance 200 open, the elastic force of the elastic means 150 acts on the open-and-shut frame 100, so that the open-and-shut frame 100 rotates around the V-shaped notched groove 110*a* to be closed. Consequently, the entrance 200*a* of the head cover body 200 is closed, so that the receiving space 200 is closed. Therefore, a general user can conveniently and easily put the golf club C into the head cover A for golf clubs.

Meanwhile, when a user desires to take the golf club C out from the head cover A, the actuating part 120 is pressed. At this time, the wings 110 integrally coupled to the actuating part 120 are opened, so that the head cover body 200 of the head cover A is opened. Thereby, the entrance 200*a* for receiving the head H of the golf club C is opened. As soon as the entrance 200*a* is opened, the receiving space 200*b* is opened, so that the user can take the golf club C out from the head cover A.

In such a state, the golf club C is taken out from the head cover A, and thereafter the force applied by the fingers is eliminated. At this time, the open-and-shut frame 100 is closed by the elastic restoring force of the elastic means 150, thus allowing the golf club C to be conveniently taken out from or inserted into the head cover A.

As described above, the present invention provides a head cover for a golf club, which can be repeatedly manufactured and is industrially available.

The present invention provides a head cover for golf clubs including a head cover body and an open-and-shut frame. The head cover body is made of cloth, and includes a head cover part which covers the head of a golf club to protect the head and a shaft cover part which extends downwards from the head cover part to surround a shaft. The open-and-shut frame is inserted into and secured to the head cover body, and includes a hinge groove which extends in a longitudinal direction, wings which are rotated around the hinge groove to be opened or closed, and elastic means which are secured to the upper and lower portions and left and right portions of the hinge groove and elastically bias the wings in an opening direction. Accordingly, the head cover for golf clubs has a simple structure, thus being easy to manufacture and enabling smooth opening and closing operation, therefore reducing manufacturing costs, and can be utilized regardless of the size of a golf club, thus being convenient to use.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. A head cover for a golf club, comprising:

an open-and-shut frame having wings which are continually urged toward a fully opened position by elastic force of elastic means;

a head cover body accommodating the open-and-shut frame therein, and including an entrance and a receiving space for receiving the golf club; and a locking unit secured to an outer surface of a middle portion of the head cover body, thus closing the entrance of the head cover body opened by the open-and-shut frame, wherein the wings are are shaped and fastened to the elastic means, and the wings extend in a length direction of the head cover body.

2. A head cover for a golf club comprising:

an open-and-shut frame having wings which are opened by elastic force of elastic means;

a head cover body accommodating the open-and-shut frame therein, and including an entrance and a receiving space for receiving the golf club; and a locking unit secured to an outer surface of a middle portion of the head cover body, thus closing the entrance of the head cover body opened by the open-and-shut frame, wherein the open-and-shut frame comprises:

a pair of arc-shaped wings extending vertically;

a semi-circular wing support part provided on lower ends of the wings to be coupled to the wings, with a hinge groove formed vertically on a central portion the wing support part; and a pair of elastic means biasing the wings in a direction for opening the wings, each of the elastic means being fastened at both ends thereof to the lower ends of the wings.

3. The head cover as set forth in claim 2, wherein the open-and-shut frame comprises wings and a wing support part which are integrated into a single structure, with a hinge groove formed vertically on the wing support part, and elastic means are provided on opposite sides of the wing support part and fastened to lower ends of the wings.

4. The head cover as set forth in claim 2, wherein the elastic means is selected from a group consisting of a plate spring, a hard steel wire, and fiber glass.

5. The head cover as set forth in claim 2 or 3, wherein an angle limiting part is installed in the open-and-shut frame or the head cover body to limit an opening angle of the open-and-shut frame.

6. The head cover as set forth in claim 5, wherein the opening angle of the open-and-shut frame which is formed between ends of the wings and the hinge groove ranges from 70° to 120°.

7. The head cover as set forth in claim 6, wherein the opening angle of the open-and-shut frame ranges from 80° to 100°.

8. A head cover for a golf club, comprising:

an open-and-shut frame having an elastic means and wings, and securing means, wherein the wings of the head cover are held in a closed position by the securing means and are opened from the closed position by elastic force of the elastic means, the wings are arc shaped and fastened to the elastic means, and the wings extend in a length direction of the head cover body.

9. The head cover as set forth in claim 8, wherein the wings of the open-and-shut frame are secured in such a way as to be unfolded and folded, the open-and-shut frame is installed in the head cover body, and the entrance of the head cover body is opened or closed by the locking unit attached to the outer surface of the head cover body.

10. The head cover as set forth in claim 1, wherein the elastic means is selected from a group consisting of a plate spring, a hard steel wire, and fiber glass.

* * * * *